US005862432A

United States Patent [19]

Nakayama et al.

[11] Patent Number: 5,862,432

[45] Date of Patent: Jan. 19, 1999

[54] IMAGE FORMING APPARATUS WHEREIN THE RESIDUAL TONER IS CHARGED AND CLEANED

[75] Inventors: Yasunori Nakayama, Gamagori; Kuniaki Kashiwakura, Toyohashi, both of Japan

[73] Assignee: Minolta Co., Ltd., Osaka, Japan

[21] Appl. No.: 806,795

[22] Filed: Feb. 26, 1997

[30] Foreign Application Priority Data

Feb. 28, 1996 [JP] Japan ..... 8-041701

[51] Int. Cl.[6] ..... G03G 15/00

[52] U.S. Cl. ..... 399/44; 399/71; 399/129

[58] Field of Search ..... 399/128, 129, 399/350, 315, 27, 44, 71; 430/110

[56] References Cited

U.S. PATENT DOCUMENTS

| | | | |
|---|---|---|---|
| 4,252,433 | 2/1981 | Sullivan | 399/350 X |
| 4,479,709 | 10/1984 | Syukuri et al. | 399/129 |
| 4,870,466 | 9/1989 | Iida | 399/129 |
| 4,945,389 | 7/1990 | Usui et al. | 399/71 |
| 5,175,584 | 12/1992 | Usui | 399/44 |
| 5,303,009 | 4/1994 | Nishizawa | 399/71 |
| 5,612,159 | 3/1997 | Sato et al. | 430/110 |
| 5,649,264 | 7/1997 | Domon et al. | 399/27 X |
| 5,663,788 | 9/1997 | Sanpe | 399/315 X |

FOREIGN PATENT DOCUMENTS

| | | |
|---|---|---|
| 64-68783 | 3/1989 | Japan . |
| 2-48683 | 2/1990 | Japan . |

*Primary Examiner*—S. Lee
*Attorney, Agent, or Firm*—McDermott, Will & Emery

[57] ABSTRACT

An image forming apparatus having a cleaner, which can be a cleaning blade, for removing residual toner from the surface of a rotatable image-bearing member, and a charger for imparting a charge to the residual toner before the residual toner is removed by the cleaner. The amount of charge imparted to the residual toner is less than 10 $\mu c$/g.

19 Claims, 9 Drawing Sheets

IMAGE FORMING APPARATUS WHEREIN THE RESIDUAL TONER IS CHARGED AND CLEANED

BACKGROUND OF THE INVENTION

1. Field of the Invention

The present invention relates to an image forming apparatus provided with a cleaning device used to remove residual toner from the surface of an image-bearing member such as a photosensitive member, dielectric member or the like in electrophotographic copiers, electrophotographic facsimile machines, electrophotographic printers and the like.

2. Description of the Related Art

Conventional image forming apparatuses are known wherein a photosensitive member provided with an image-bearing member on the surface thereof is charged, and the surface of said photosensitive member is optically exposed in accordance with image information to form an electrostatic latent image which is then developed as a toner image by a developing device, and said toner image is transferred onto a paper sheet, and the residual toner remaining on the surface of the image-bearing member is removed therefrom. In such image forming apparatuses, a precleaning charger is provided in front of the cleaning device to improve the cleaning characteristics by discharging the charge of the residual toner and weakening the electrostatic attractive force of the photosensitive member. It has been proposed that a precleaning charger may be controlled by controlling the output of the precleaning charger in accordance with the amount of toner adhered to the image-bearing member after the image transfer as disclosed, for example, in Japanese Unexamined Patent Application No. SHO 64-68783, or the charge of the residual toner remaining on the surface of the image-bearing member may be set to either positive or negative by means of said precleaning charger, as disclosed in Japanese Unexamined Patent Application No. HEI 2-48683.

OBJECTS AND SUMMARY

Removing residual toner is subject to cleaning instability inasmuch as the amount of charge of the residual toner remaining on the surface of the image-bearing member differs with every image forming process, and the output of the precleaning charger is affected by environmental fluctuations.

In view of the aforesaid disadvantages, an object of the present invention is to provide an image forming apparatus capable of stable cleaning regardless of environmental fluctuations or fluctuations of the image forming process.

These objects are achieved by providing an image forming apparatus of the electrophotographic type provided with a cleaning blade to remove residual toner on the surface of an image-bearing member, and charge controller disposed upstream from said cleaning blade to control the amount of charge of residual toner remaining on the surface of said image-bearing member after image transfer, and a power source to supply a voltage to said charge controller so as to maintain the absolute value of the charge of the residual toner at less than 10 $\mu$c/g.

According to the aforesaid construction, stable cleaning is accomplished regardless of environmental fluctuations or fluctuations of the image forming process by weakening the force of adhesion between the residual toner and photosensitive member by means of regulating the amount of charge of the residual toner on the surface of the image-bearing member to less than 10 $\mu$c/g before cleaning by said cleaning blade via a charge controlling means.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 5:
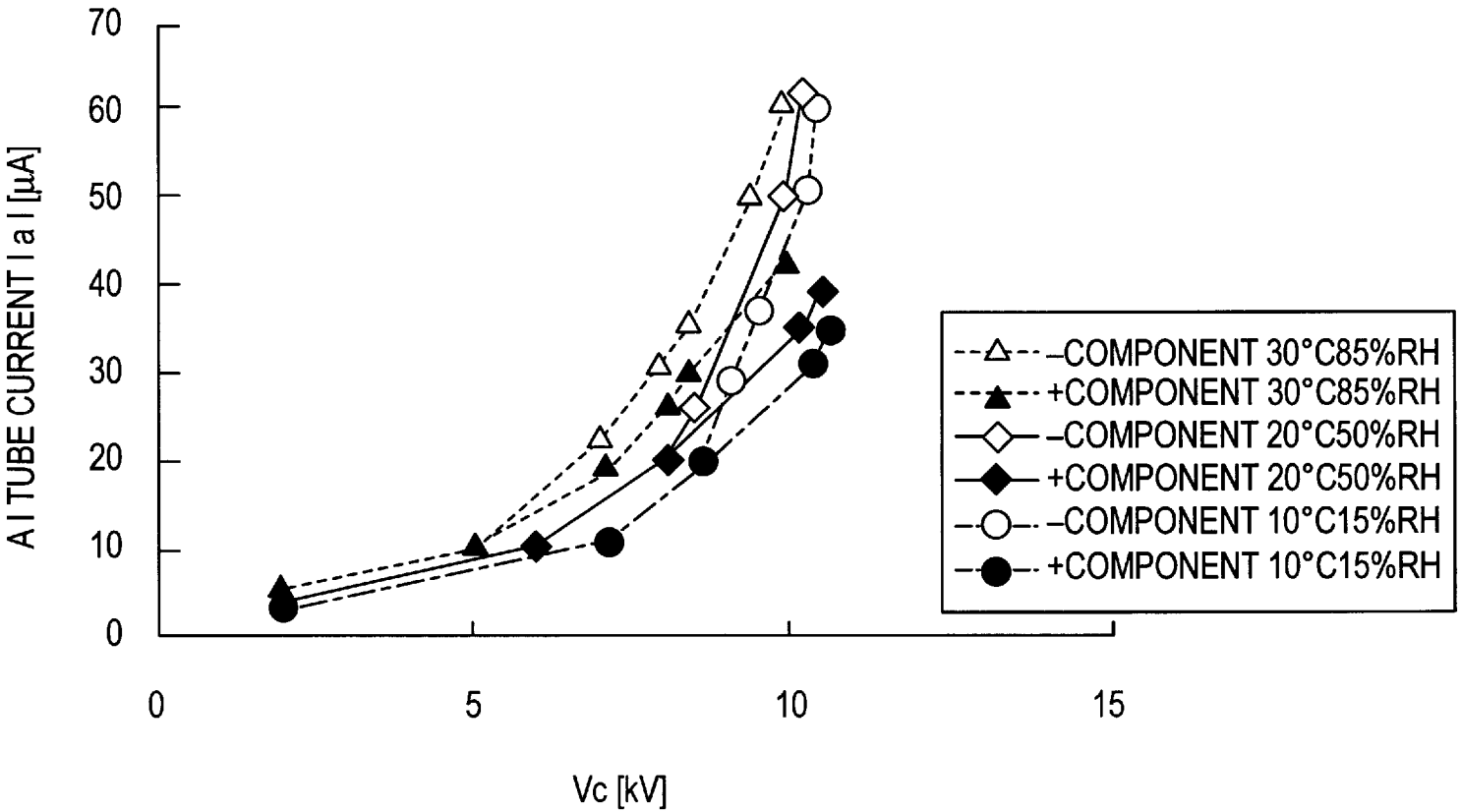
FIG. 5 shows the changes in the output of the precleaning charger relative to changes in the output of the AC constant-voltage power supply.

In order to attain the previously described objects, the present inventors conducted a research which resulted in the findings shown in FIGS. 5 through 9. FIG. 5 shows the change in output of the precleaning charger relative to the change in output of the AC constant-voltage power supply. The output of the AC constant-voltage power supply is measured in voltage Vc units, and an aluminum tube electrode (hereinafter referred to as "tube electrode Al") is provided as an opposing electrode confronting the precleaning charger, and the output of the precleaning charger is measured in current Ial flowing to said tube electrode Al. In the drawing, the symbols Δ and ▲ are respectively the negative component and positive component of current Ial under environmental conditions of 30° C. and 85% relative humidity (hereinafter referred to as "35° C./85% RH"), and the symbols ◇ and ◆ are respectively the negative component and positive component of current Ial under environmental conditions of 20° C. and 50% relative humidity (hereinafter referred to as "20° C./50% RH"), and the symbols ○ and ● are respectively the negative component and positive component of current Ial under environmental conditions of 10° C. and 15% relative humidity (hereinafter referred to as "10° C./15% RH").

According to FIG. 5, under environmental conditions of 35° C./85% RH, the output of the AC constant-voltage power supply produces identical increases in both negative and positive components of the current Ial up to the vicinity of 7 kV, and thereafter the negative component increases more markedly. Similarly, under environmental conditions of 20° C./50% RH, the output of the AC constant-voltage power supply produces identical increases in both negative and positive components of the current Ial up to the vicinity of 8 kV, and thereafter the negative component increases more markedly. Under environmental conditions of 10° C./15% RH, the output of the AC constant-voltage power supply produces identical increases in both negative and positive components of the current Ial up to the vicinity of 8.4 kV, and thereafter the negative component increases more markedly. It can be said form the above findings that the output trend of the precleaning charger differs depending on environmental fluctuations of temperature and humidity and the like, i.e., output differs at high temperature and high humidity relative to low temperature and low humidity, even when the output of the AC constant-voltage power supply is set at a predetermined voltage.

Figure 6:
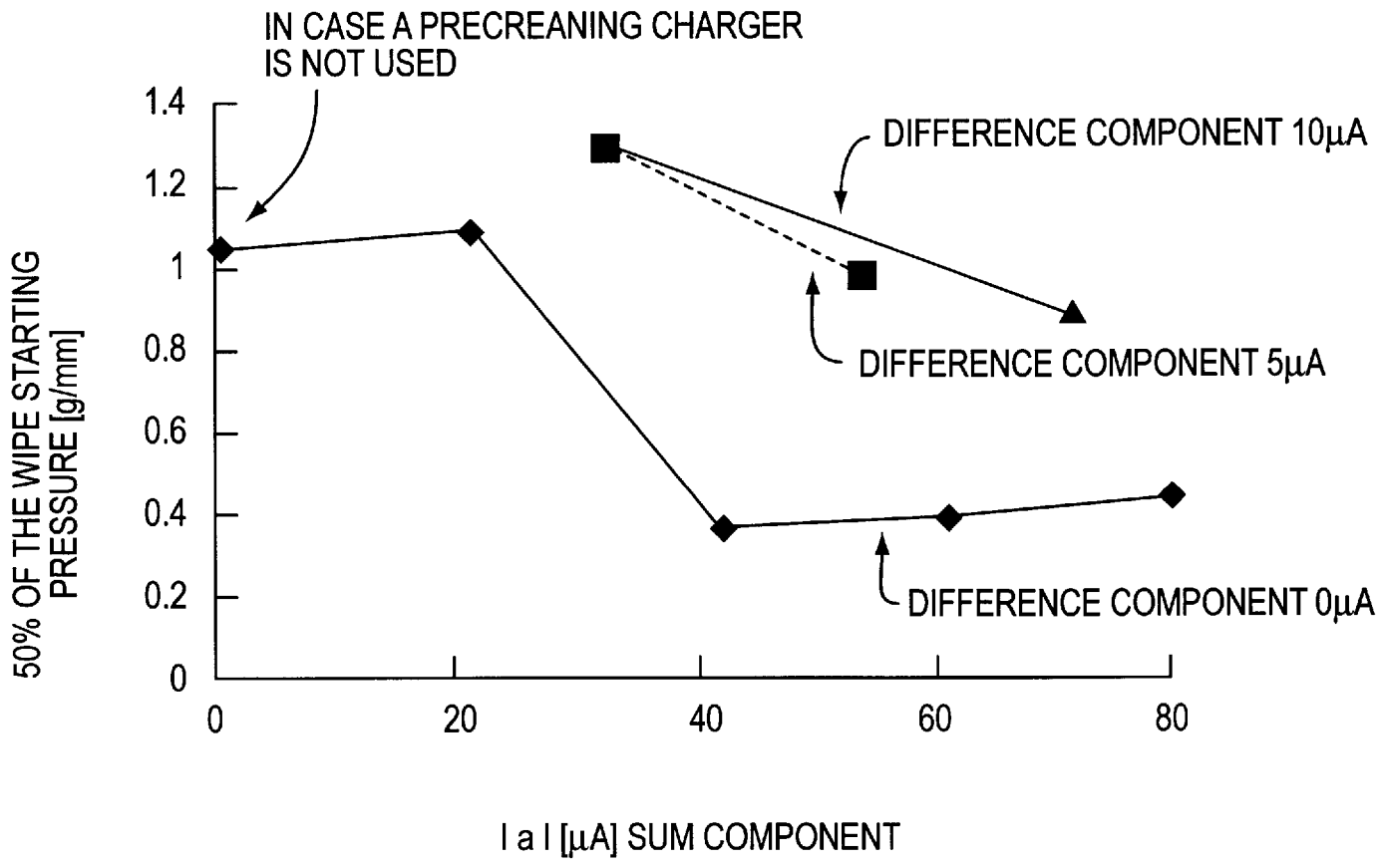
FIG. 6 shows the changes in the cleaning characteristics relative to changes in the output of the precleaning charger.

FIG. 6 shows the changes in cleaning characteristics relative to changes in the output of the precleaning charger. The output of the precleaning charger is shown as the sum component and difference component of tube current Al. Cleaning characteristics were evaluated at 50% of the wipe starting pressure. The 50% of the wipe starting pressure is the contact pressure when the width being wiped is 50% of the image forming width when 0.12 mg/cm$^2$ of toner is adhered on the entire surface of the photosensitive drum and cleaning is accomplished while the contact pressure of the cleaning blade on the photosensitive drum changes. Cleaning characteristics are best when the 50% wipe starting pressure is small. In FIG. 6, ○ indicates a difference component of 0 μA for Al tube current Ial, ▲ indicates a difference component of 5 μA for Al tube current Ial, and * indicates a difference component of 10 μA for Al tube current Ial. The sum component is obtained by adding the absolute values of the value of the positive component and the value of the negative component, and the difference component the absolute value of the difference between the positive component and the negative component.

According to FIG. 6, when the difference component of Al tube current Ial is 0 μA and the sum component of current Ial changes, cleaning characteristics starting improving above about 20 μA and are stable above about 40 μA. When the difference component of Al tube current Ial is 5 μA, however, cleaning characteristics are no different than when a precleaning charger is not used, even when the sum component of the current Ial is set at 50 μA. Similarly, when the difference component of the Al tube current Ial is 10 μA, cleaning characteristics are no different than when a precleaning charger is not used, even when the sum component of current Ial is set at 60 μA. This result is believed to be sue to inadequate discharging of the residual toner when the negative load of the same polarity as the toner is set too high. Thus, the difference component of the Al tube current Ial is desirably set as near as possible to zero.

Figure 7:
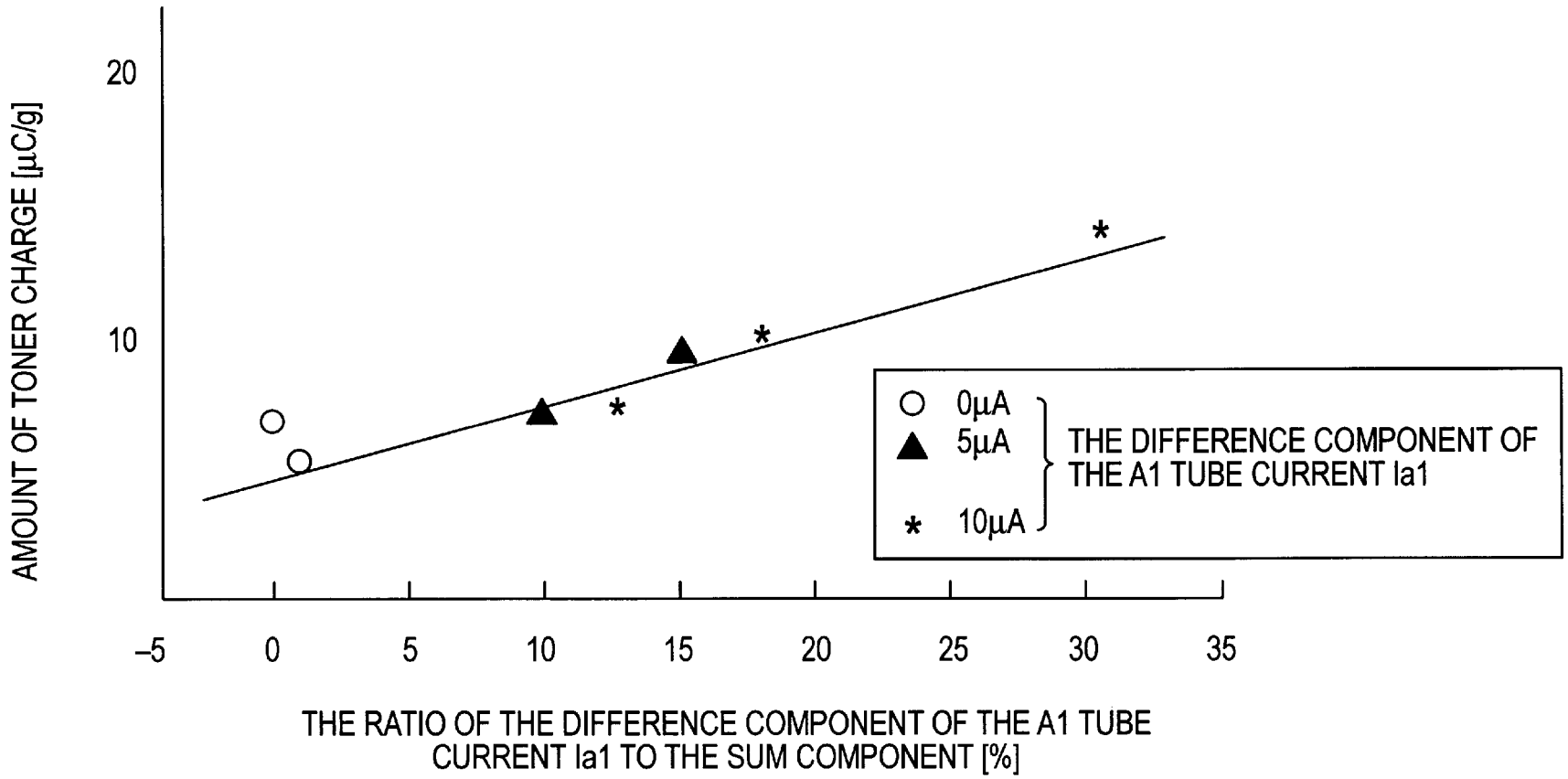
FIG. 7 shows the changes in the amount of toner charge in the cleaning device relative to changes in the output of the precleaning charger.

FIG. 7 shows the change in the amount of toner charge in the cleaning device relative to change in the output of the precleaning charger. The output of the precleaning charger is expressed as the ratio of the difference component of the Al tube current Ial to the sum component. Furthermore, the amount of toner charge is calculated from the amount of toner removed and the charge required to move the toner when removing the toner adhered to the surface of the photosensitive drum. The amount of toner charge before the toner passes the precleaning charger is set at 20 μc/g, and the amount of toner adhered to the surface of the photosensitive drum is set at 0.12 mg/cm2. In FIG. 7, ○ indicates a difference component of 0 μA for Al tube current Ial, ▲ indicates a difference component of 5 μA for Al tube current Ial, and * indicates a difference component of 10 μA for Al tube current Ial.

According to FIG. 7, the amount of toner charge increases when the ratio of the difference component and sum component of the Al tube current Ial becomes larger.

Figure 8:
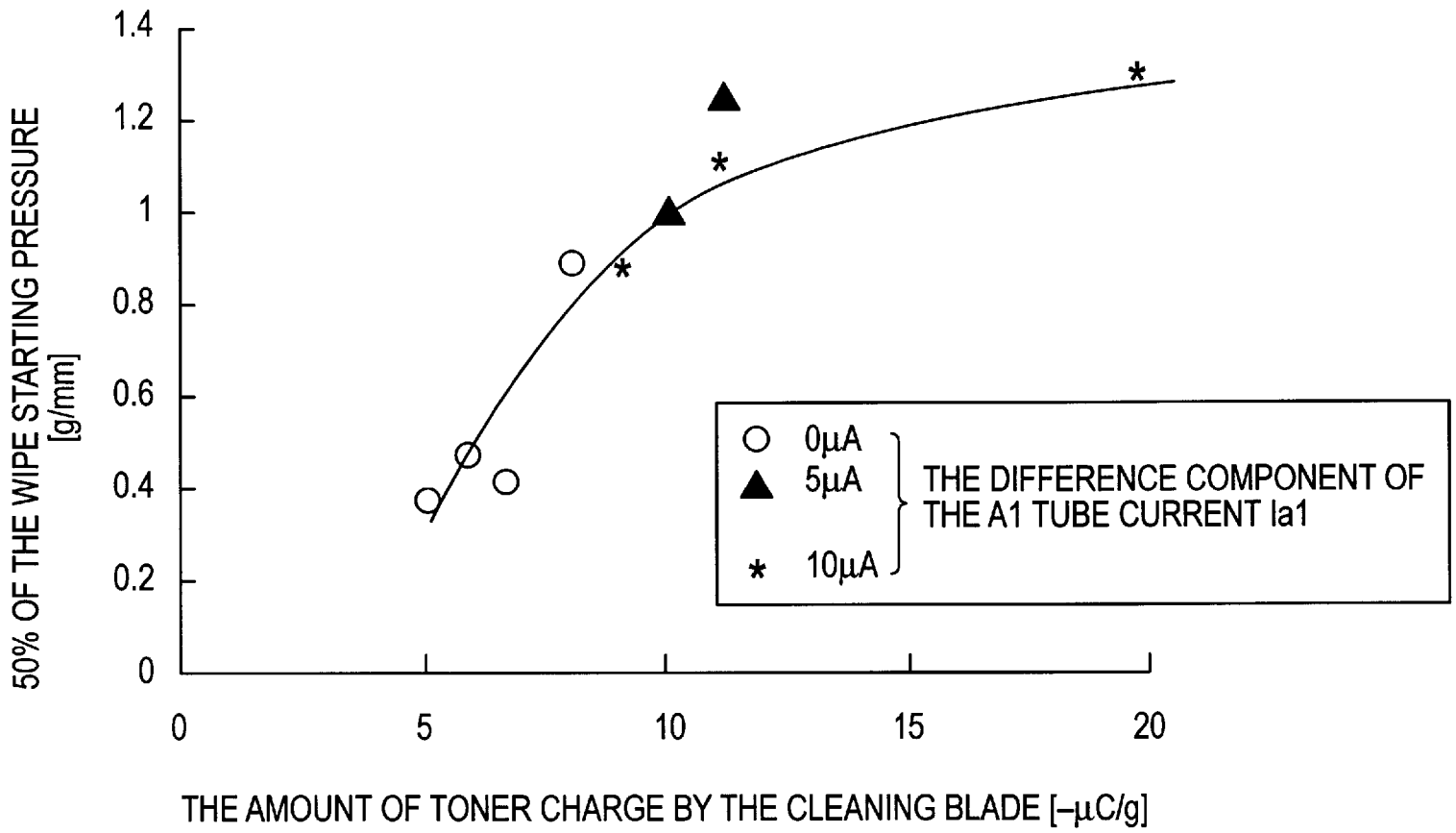
FIG. 8 shows the changes in cleaning characteristics relative to the amount of toner charge on the cleaning blade; variety of FIG. 9 shows the changes in cleaning characteristics when the image forming apparatus system speed and precleaning charger output change.

FIG. 8 shows the change in cleaning characteristics relative to the amount of toner charge by the cleaning blade. The amount of toner charge is calculated from the amount of toner removed and the amount of charge required to move the toner when removing the toner as previously described. Cleaning characteristics were evaluated at 50% of the wipe starting pressure as previously described. In FIG. 8, ○ indicates a difference component of 0 μA for Al tube current Ial, ▲ indicates a difference component of 5 μA for Al tube current Ial, and * indicates a difference component of 10 μA for Al tube current Ial.

According to FIG. 8, although no great difference in cleaning characteristics were observed when the amount of toner charge on the surface of the photosensitive drum was greater than 10 μc/g, cleaning characteristics improved when the 50% wipe starting pressure was reduced in conjunction with reducing the amount of toner charge below 10 μc/g. This improvement is believed to be due to the great reduction in toner adhesion force relative to the photosensitive drum when the amount of toner charge was less than 10 μc/g.

Figure 9:
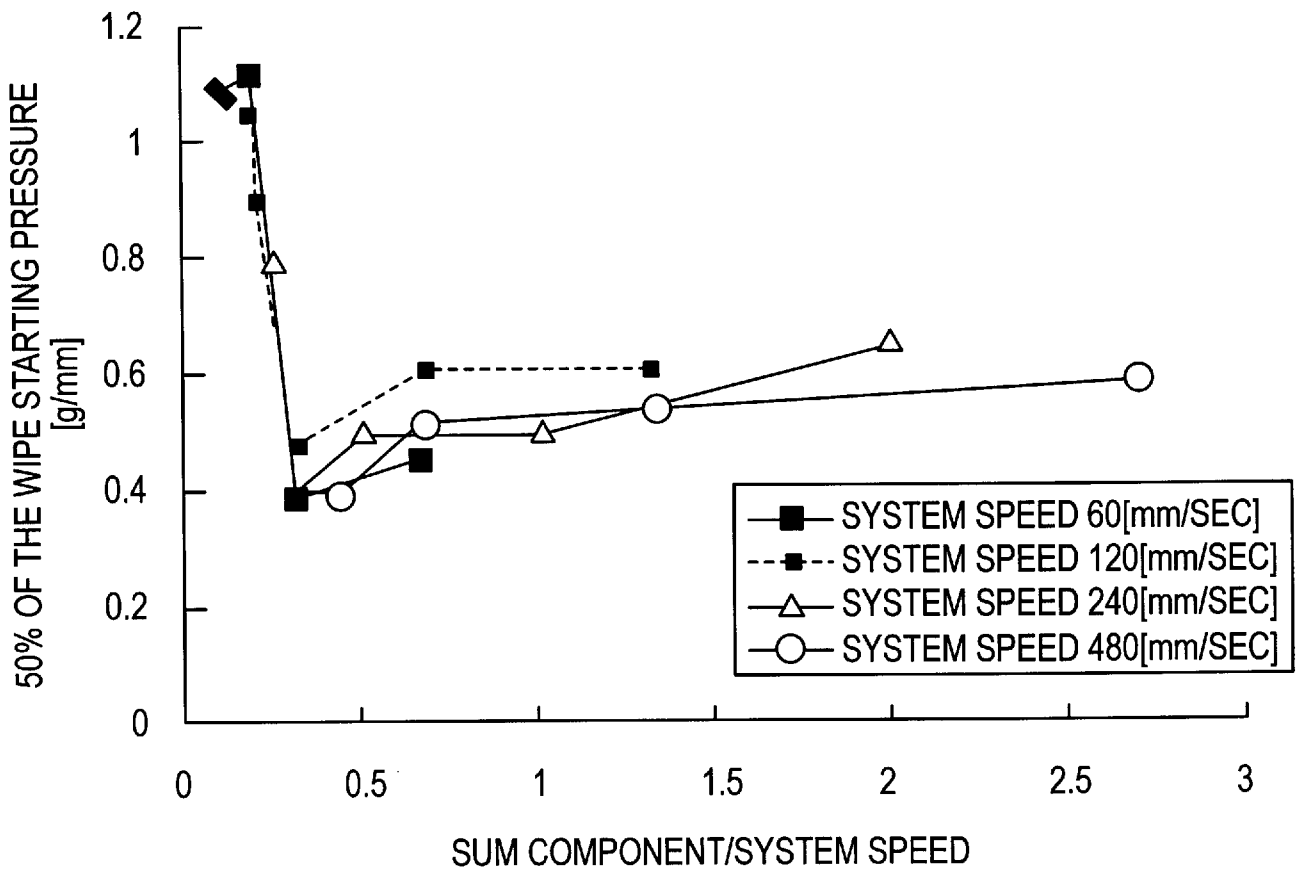

FIG. 9 shows the change in cleaning characteristics when the image forming apparatus system speed and output of the precleaning charger change. That is, the horizontal axis shows the ratio of the sum component of Al tube current Ial relative to the system speed, and the vertical axis shows the 50% wipe starting pressure. The difference component of the Al tube current Ial was adjusted to 0 μA.

According to FIG. 9, excellent and stable cleaning characteristics were obtained when the ratio of the sum component to system speed was greater than 0.3. It thus became clear that it is desirable to adjust the sum component of the Al tube current Ial of the precleaning charger so as to attain a ratio of the sum component to system speed greater than 0.3 (i.e., ⅓).

It is clear from the aforesaid findings that in order to improve cleaning characteristics, it is desirable to adjust the toner charge imparted by the cleaning blade to less than 10 μc/g, and to accomplish this by adjusting the voltage supplied to the precleaning charger so as to attain a sum component of the Al tube current Ial of the precleaning charger of more than 40 μA, and a ratio of the difference component to the sum component of less than 15%.

The preferred embodiments of the present invention are described hereinafter based on the previously described experimental findings.

Figure 1:
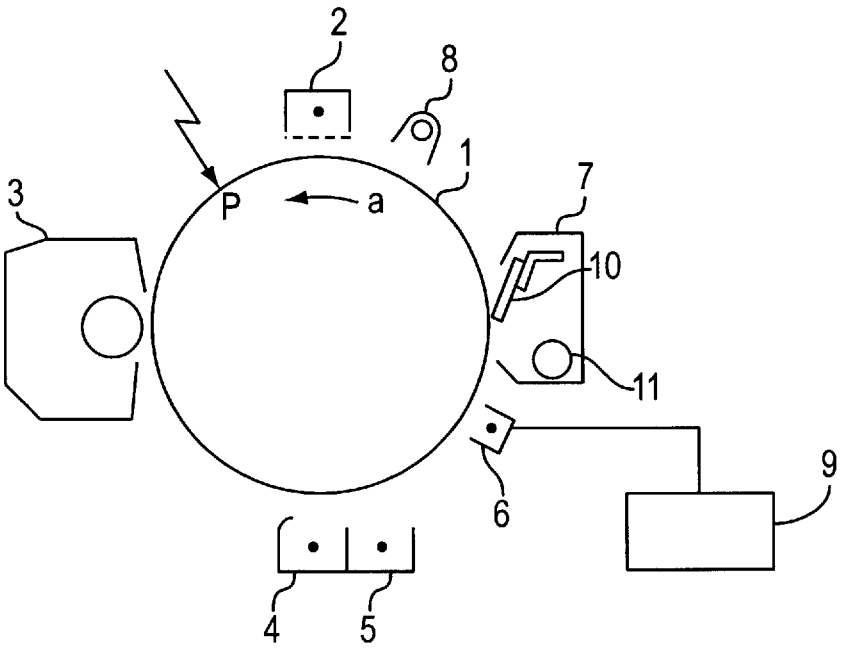
FIG. 1 briefly shows the image forming apparatus of a first embodiment of the invention.

FIG. 1 shows an image forming apparatus of a first embodiment of the present invention. This image forming apparatus is provided with a photosensitive drum 1 which is rotatable in the arrow a direction. Arranged sequentially around the periphery of photosensitive drum 1 in the direction of rotation are a scorotron type charger 2 as a charging means, developing device 3, transfer charger 4 as a transfer means, separation charger 5 as a transfer sheet discharging and separation means, precleaning charger 6 as a charge controlling means, cleaning device 7, and eraser device 8. Light corresponding to image information is exposed on the surface of photosensitive drum 1 at position P between charger 2 and developing device 3.

Photosensitive drum 1 comprises sequential laminations of a charge generating layer 1 μm in thickness, and a charge transporting layer about 23 μAm in thickness as an organic photoconductive member (OPC) formed over an electrically conductive substrate of an aluminum tube having a cylindrical drum-like shape.although an overcoat layer may be provided over the charge transporting layer, and an undercoat layer may be provided on the conductive substrate, the present invention is not limited to such arrangements. A selenium photosensitive member, Cds photosensitive member, amorphous silicon photosensitive member and the like may be used instead of said organic photoconductive member. Furthermore, a belt-like conductive substrate may be substituted for the drum-like conductive substrate.

The charger 2 is connected to the negative side of a power source (not illustrated), and charges photosensitive drum 1 to a negative potential.

Developing device 3 is a dry-type two-component developing device which uses a magnetic carrier and nonmagnetic toner charged with a negative polarity. A monocomponent developing device which uses only toner, or a wet-type developing device which uses ink or pigment particles dissolved in an isobar or the like may be substituted for the dry-type two-component developing device 3.

The precleaning charger 6 is connected to an AC constant-voltage power source 9. This power source 9 regulates the voltage so as to attain a sum component obtained by adding the absolute value of the current on the negative side to the absolute value of the current on the positive side such that said sum component is greater than 40 μA. In the present embodiment, the voltage is regulated at 8.4 kV. Since the power source 9 is an AC power source, the difference component derived by subtracting the absolute value of the current on the negative side from the absolute value of the current on the positive side is zero insofar as there are no disturbances due to environmental fluctuations and the like.

In addition to the aforesaid AC constant-voltage power source, the type of power source supplying current to the precleaning charger 6 may be an alternative current (AC) power source which overlays a direct current (DC) bias, a constant-current type AC power source or the like. In the case of an AC o=power source which overlays a DC bias voltage, the DC voltage or AC voltage must be regulated in order to maintain a sum component greater than 40 μA and a ratio of the difference component to the sum component less than 15% because a difference component will arise.

Cleaning device 7 is provided with a cleaning blade 10 formed of urethane resin, and a transport screw 11. Cleaning blade 10 is arranged such that the leading edge of the blade presses against the photosensitive drum 1 at an incline toward the upstream side in the direction of rotation. In addition to polyurethane resin, teflon resin and the like may be used as the material of cleaning blade 10. Transport screw 11 transports toward the end (i.e., the end in a direction perpendicular to the paper surface in FIG. 1) of the cleaning device to collect the residual toner swept up by the cleaning blade 10.

In the image forming apparatus of the aforesaid construction, the surface of photosensitive drum 1 is charged to a negative potential by charger 2, and positive recording light corresponding to image information is exposed at the exposure position P to form an electrostatic latent image. This electrostatic latent image is developed as a toner image via developing device 3 so as to be rendered visible, and the toner image is transferred onto a transfer member such as a paper sheet, film or the like (not shown in the drawing) via transfer charger 4. The untransferred residual toner remaining on the surface of photosensitive drum 1 is discharged by precleaning charger 6.

At this time, the output voltage of precleaning charger 6 is regulated so as to attain a sum component of the current of more than 40 μA, and a ratio of the difference component relative to the sum component of less than 15% when a DC voltage is overlaid, such that the amount of charge of the residual toner is 10 μc/g or less. Since the amount of charge on the residual toner is reduced by the precleaning charger 6, the residual toner is completely removed by the cleaning blade 10 of cleaning device 7 regardless of environmental fluctuations or changes in the image forming process. After cleaning, the photosensitive drum 1 is discharged by eraser device 8 in preparation for the next image forming process. In the present embodiment, the system speed is 120 mm/sec.

Although the charge of the residual toner is regulated at less than 10 μc/g by preadjusting the output voltage of the precleaning charger 6 to a constant value in the aforesaid embodiment, it is to be noted that the output voltage of the precleaning charger 6 may be adjusted during an image forming operation in accordance with the amount of residual toner and ambient temperature and humidity as in the embodiment described below.

Figure 2:
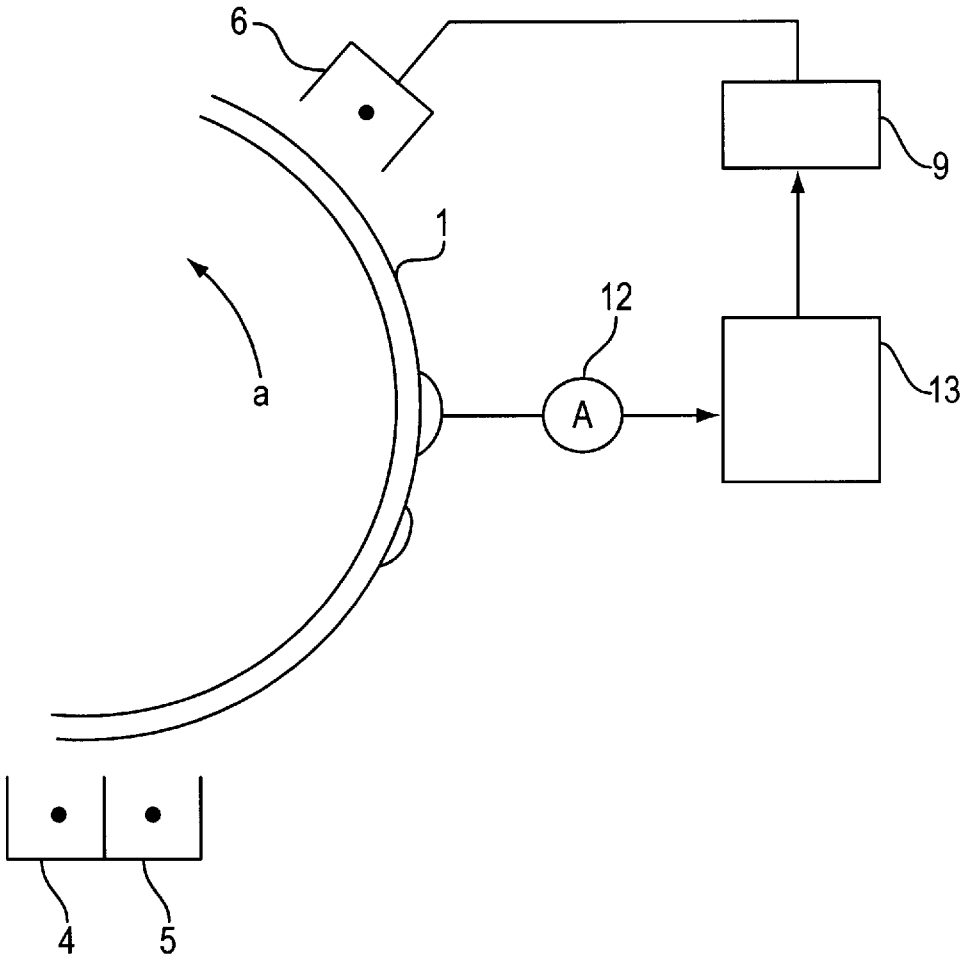
FIG. 2 is a partial enlargement of the image forming apparatus of a second embodiment of the invention.

FIG. 2 shows an arrangement whereby the output voltage of the precleaning charger 6 is regulated in accordance with the amount of residual toner. This image forming apparatus is provided with a transfer and separation chargers 4 and 5, an ammeter 12 having a pin in contact with the residual toner on the surface of photosensitive drum 1 disposed between precleaning charger 6 and transfer and separation chargers 4 and 5, and a controller 13 to control the output voltage of precleaning charger 6 based on the current value measured by said ammeter 12. When there is residual toner present on the surface of photosensitive drum 1, the current value measured by ammeter 12 changes in accordance with the amount of toner charge. Controller 13 stores tables developed beforehand which express the relationships between the output voltage of precleaning charger 6 required to achieve a toner charge of 10 μc/g or less, and the amount of charge of residual toner estimated from the change in the current value measured by ammeter 12. An example of such a table is shown in Table 1 below.

TABLE 1

| Estimated value of residual toner charge (μc/g) | Output of precleaning charger 6 (kV) |
|---|---|
| 0 to 10 | — |
| 10 to 20 | 6.0 |
| 20+ | 8.4 |

Controller 13 estimates the amount of charge of the residual toner from the change in the current value measured by ammeter 12, and determined the output voltage of precleaning charger 6 based on the estimated charge in accordance with the aforesaid table, and outputs the value to power source 9. Thus, a voltage appropriate for the charge of the residual toner is supplied to precleaning charger 6, and the amount of charge of the residual toner that passes said precleaning charger 6 is controlled to less than 10 μc/g.

Figure 3:
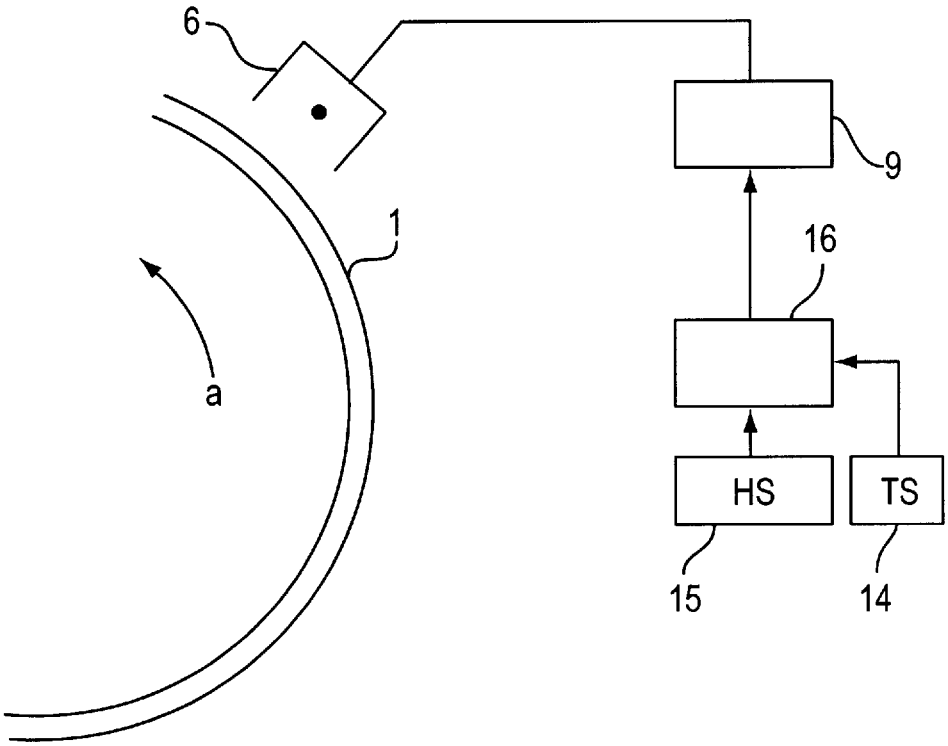
FIG. 3 is a partial enlargement of the image forming apparatus of a third embodiment of the invention.

FIG. 3 shows an arrangement whereby the output voltage of precleaning charger 6 is regulated in accordance with ambient temperature and humidity. This image forming apparatus is provided with a temperature sensor 14 and humidity sensor 15, and a controller 16 which regulates the output voltage of the power source 9 of precleaning charger 6 based on the temperature and humidity detected by said sensors. Controller 16 stores tables developed beforehand which express the relationship between the temperature and humidity detected by temperature sensor 14 and humidity sensor 15, and the output voltage of precleaning charger 6 required to achieve a toner charge of 10 $\mu$c/g or less under the temperature and humidity conditions detected by temperature sensor 14 and humidity sensor 15. An example of such a table is shown in Table 2 below.

TABLE 1

| Temp/humidity detection result | Output of precleaning charger 6 (kV) |
|---|---|
| LL | 8.4 |
| NN | 8.0 |
| HH | 7.0 |

Controller 16 determines the output voltage of precleaning charger 6 based on the temperature and humidity detected by temperature sensor 14 and humidity sensor 15 in accordance with the aforesaid table, and outputs the value to power source 9. Thus, the power source 9 supplies to precleaning charger 6 a voltage appropriate to the amount of toner charge, such that the amount of charge of the residual toner that passes the precleaning charger 6 is regulated to less than 10 $\mu$c/g.

Figure 4:
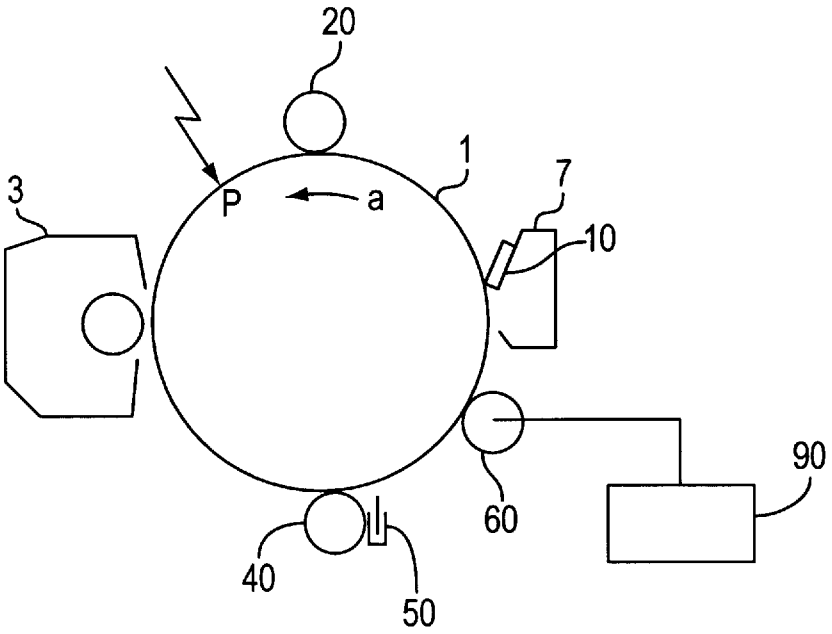
FIG. 4 briefly shows the image forming apparatus of a fourth embodiment of the invention.

Although the image forming apparatuses of the aforesaid embodiments use a precleaning charger 6 as a residual toner controlling means, the present invention may be adapted to an image forming apparatus which substitutes a precleaning roller 60 such as shown in FIG. 4 in place of said precleaning charger 6. In this image forming apparatus, not only is a precleaning roller 60 used as a residual toner controlling means, but a charging roller 20 is used as a charging means, a transfer roller 40 is used as a transfer means, and a discharge probe 50 is used as a transfer sheet discharge and separation means, and a charger is used which utilizes a corona discharge so as to not harm the ozone layer.

This image forming apparatus is provided with a power source 90 which supplies an AC voltage identical to the one of the first embodiment to precleaning roller 60. An AC voltage having a sum component greater than 40 $\mu$A and a ratio of the difference component to the sum component of less than 15% is supplied to the precleaning roller 60 such that the amount of charge of the residual toner that passes the precleaning roller 60 is less than 10 $\mu$c/g. Of course, power source 90 may be provided with the controllers 13 and 16 shown in FIGS. 2 and 3, to control the output voltage of precleaning roller 60.

Furthermore, the residual toner may be charged by a wire electrode or scorotron charger instead of the precleaning charger 6 and precleaning roller 60.

As can be clearly understood from the preceding description, the previously described embodiments provide stable cleaning by regulating the amount of charge of residual toner at less than 10 $\mu$c/g via a charge controlling means prior to cleaning regardless of changes in the amount of charge of the residual toner remaining after the image transfer differs for each image forming process, or the influence of environmental fluctuations affecting the output of said charge controlling means. Thus, the present invention is effective in maintaining excellent cleaning characteristics over long periods, and as a result prolongs the service life of the photosensitive member and cleaning blade without changing the pressure contact of the cleaning blade on the photosensitive member.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus of an electrophotographic type comprising:

a cleaner for removing residual toner;

a charger disposed upstream from said cleaner in a direction of rotation of an image-bearing member for imparting a charge to the residual toner remaining on the image-bearing member after a toner image is transferred to a receiving material; and a power source for supplying power to said charger to charge said residual toner to attain an absolute value of an amount of charge of said residual toner of less than 10 $\mu$c/g, wherein the power source supplies a voltage to said charger to attain a sum component of more than 40 $\mu$A of a current flowing from said charger to said image-bearing member, and said sum component of said current is obtained by adding an absolute value of a peak value of a positive component and an absolute value of a peak value of a negative component of the current flowing when said voltage is supplied.

2. An image forming apparatus of an electrophotographic type comprising:

a cleaner for removing residual toner;

a charger disposed upstream from said cleaner in a direction of rotation of an image-bearing member for imparting a charge to the residual toner remaining on the image-bearing member after image transfer; and a power source for supplying power to said charger, wherein said power source supplies a voltage comprising a direct current voltage overlaid on an alternating current voltage to said charger, wherein the voltage supplied from the power source to the charger attains a relationship between a sum component and a difference component of a current flowing from said charger to said image-bearing member of:

$$(\text{difference component})/(\text{sum component}) \leqq 0.15,$$

the sum component of said current is the sum obtained by adding absolute values of a peak value of a positive component and a peak value of a negative component of the current flowing when a voltage is supplied, and the difference component of said current is the difference between the absolute values of the peak value of the positive component and the peak value of the negative component of the current flowing when the voltage is supplied.

3. An image forming apparatus of an electrophotographic type comprising:

a cleaner for removing residual toner;

a charger disposed upstream from said cleaner in a direction of rotation of an image-bearing member for imparting a charge to the residual toner remaining on the image-bearing member after image transfer;

a power source for supplying power to said charger;

a temperature sensor for detecting temperature;

a humidity sensor for detecting humidity near said image-bearing member; and a controller for controlling said power source supplying a voltage to said charger to charge said residual toner to attain an absolute value of charge of less than 10 $\mu$c/g based on an output of said temperature sensor and an output of said humidity sensor.

4. An image forming apparatus of an electrophotographic type comprising:

a charge controller for controlling an amount of charge of residual toner remaining on a rotatable image-bearing member after a toner image is transferred to a receiving material;

a power source for supplying an alternating current voltage to said charge controller to attain an absolute value of residual toner charge of 10 $\mu$c/g; and a cleaner disposed upstream from the charge controller in a direction of movement of said rotatable image-bearing member to remove residual toner, wherein said power source supplies the alternating current voltage to attain a sum component of more than 40 $\mu$A of a current flowing to said rotatable image-bearing member from said charge controller; and said sum component of said current is obtained by adding an absolute value of a peak value of a positive component and an absolute value of a peak value of a negative component of the current flowing when said voltage is supplied.

5. The image forming apparatus of claim 4, wherein said cleaner is a cleaning blade.

6. An image forming apparatus of an electrophotographic type comprising:

a charge controller for controlling an amount of charge of residual toner remaining on a rotatable image-bearing member after a toner image is transferred to a receiving material;

a power source for supplying a direct current voltage overlaid on an alternating current voltage as a voltage to said charge controller to attain an absolute value of residual toner charge of 10 $\mu$c/g; and a cleaner disposed upstream from the charge controller in a direction of movement of said rotatable image-bearing member to remove residual toner, wherein said power source supplies the voltage to attain a relationship between a sum component and a difference component of a current flowing from said charge controller to said rotatable image-bearing member, of:

$$(\text{difference component})/(\text{sum component}) \leqq 0.15,$$

said sum component of said current is obtained by adding an absolute value of a peak value of a positive component and an absolute value of a peak value of a negative component of the current flowing when said voltage is supplied, and the difference component of said current is the difference between the absolute values of the peak value of the positive component and the peak value of the negative component of the current flowing when said voltage is supplied.

7. The image forming apparatus of claim 6, wherein said cleaner is a cleaning blade.

8. An image forming apparatus of an electrophotographic type comprising:

a charge controller for controlling an amount of charge of residual toner remaining on a rotatable image-bearing member after a toner image is transferred to a receiving material;

a power source for supplying an alternating current voltage to said charge controller to attain an absolute value of residual toner charge of 10 $\mu$c/g; and a cleaner disposed upstream from the charge controller in a direction of movement of said rotatable image-bearing member to remove residual toner, wherein a relationship between a sum component ($\mu$A) of a current flowing from said charge controller to said rotatable image-bearing member and speed (mm/sec) of said rotatable image-bearing member is:

$$\text{current sum component}/\text{system speed} \geqq 1/3.$$

9. The image forming apparatus of claim 8, wherein said cleaner is a cleaning blade.

10. An image forming apparatus of an electrophotographic type comprising:

a cleaner for removing residual toner from a rotatable image-bearing member;

a charger disposed upstream from said cleaner in a direction of movement of said rotatable image-bearing member for imparting a charge to residual toner remaining on said rotatable image-bearing member after a toner image is transferred to a receiving material;

a power source for supplying an alternating current voltage to said charger; and a controller for controlling the alternating current voltage from said power source supplied to said charger to attain a sum of absolute values of a peak value of a positive component and a peak value of a negative component of a current flowing from said charger to said rotatable image-bearing member such that said sum is greater than 40 $\mu$A.

11. The image forming apparatus of claim 10, wherein said power source supplies a direct current voltage overlaid on said alternating current voltage to said charger.

12. The image forming apparatus of claim 11, wherein said controller controls the voltage supplied from the power source to the charger to attain a relationship between a sum component and a difference component of the current flowing from said charger to said rotatable image-bearing member of:

$$(\text{difference component})/(\text{sum component}) \leqq 0.15 \text{ and}$$

the sum component of said current is the sum obtained by adding the absolute values of the peak value of the positive component and the peak value of the negative component of the current flowing when the voltage is supplied, and the difference component of said current is a difference between the absolute values of the peak value of the positive component and the peak value of the negative component of the current flowing when the voltage is supplied.

13. The image forming apparatus of claim 10, wherein said cleaner is a cleaning blade.

14. A method of cleaning residual toner from an image-bearing member in an image forming apparatus of an electrophotographic type after transferring a toner image from said image-bearing member to a receiving material, comprising the steps of:

charging said residual toner remaining on said image-bearing member to attain an absolute value of charge of 10 $\mu$c/g by causing a current to flow to said image-bearing member utilizing a source providing an alternating current voltage, during charging said residual toner remaining on said image-bearing member, a sum of absolute values of a peak value of a positive component and a peak value of a negative component of said current flowing to said image-bearing member is greater than 40 $\mu$A; and sweeping said residual toner having said absolute value of charge of 10 $\mu$c/g from said image-bearing member by a cleaner.

15. The method of claim 14, wherein in said step of sweeping, said cleaner is a cleaning blade.

16. A method of cleaning residual toner from an image-bearing member in an image forming apparatus of an electrophotographic type after transferring a toner image from said image-bearing member to a receiving material, comprising the steps of:

detecting ambient temperature around the image-bearing member and determining a voltage level for charging said residual toner based on the detected ambient temperature;

charging said residual toner remaining on said image-bearing member with the determined voltage level to attain an absolute value of charge of 10 $\mu$c/g; and sweeping residual toner having said absolute value of charge of 10 $\mu$c/g from said image-bearing member by a cleaner.

17. The method of claim 16, wherein said cleaner is a cleaning blade.

18. A method of cleaning residual toner from an image-bearing member in an image forming apparatus of an electrophotographic type after transferring a toner image from said image-bearing member to a receiving material, comprising the steps of:

charging said residual toner remaining on said image-bearing member to attain an absolute value of charge of 10 $\mu$c/g by causing a current, having a sum component and a difference component, to flow to said image-bearing member utilizing an alternating current power source overlaid on a direct current bias, the sum component of said current being the sum obtained by adding absolute values of a peak value of a positive component and a peak value of a negative component of the current, the difference component of said current being the difference between the absolute values of the peak value of the positive component and the peak value of the negative component of the current, and during said step of charging said residual toner remaining on said image-bearing member, $$(\text{difference component})/(\text{sum component}) \geqq 0.15; \text{ and}$$

sweeping residual toner having said absolute value of charge of 10 $\mu$c/g from said image-bearing member by a cleaner.

19. The method of claim 18, wherein said cleaner is a cleaning blade.

* * * * *

UNITED STATES PATENT AND TRADEMARK OFFICE

CERTIFICATE OF CORRECTION

PATENT NO. : 5,862,432

DATED : January 19, 1999

INVENTOR(S) : Yasunori NAKAYAMA et al.

It is certified that error appears in the above-identified patent and that said Letters Patent is hereby corrected as shown below:

Col. 12, line 23, delete ">" and insert --<--.

Signed and Sealed this

First Day of June, 1999

*Attest:*

Q. TODD DICKINSON

*Attesting Officer*

*Acting Commissioner of Patents and Trademarks*